US008499854B2

(12) United States Patent
Mitchell et al.

(10) Patent No.: US 8,499,854 B2
(45) Date of Patent: Aug. 6, 2013

(54) ROTATING CONTROL DEVICE, COOL FLUID CIRCULATION SYSTEM AND METHODS OF OPERATION

(75) Inventors: Chad Orval Mitchell, Sylvan Lake (CA); Randolph John Fasick, Red Deer (CA)

(73) Assignee: Enhanced Petroleum Services Partnership (CA)

( * ) Notice: Subject to any disclaimer, the term of this patent is extended or adjusted under 35 U.S.C. 154(b) by 306 days.

(21) Appl. No.: 12/879,140

(22) Filed: Sep. 10, 2010

(65) Prior Publication Data

US 2011/0079430 A1 Apr. 7, 2011

Related U.S. Application Data

(60) Provisional application No. 61/241,317, filed on Sep. 10, 2009.

(51) Int. Cl.
*E21B 7/00* (2006.01)

(52) U.S. Cl.
USPC ..... 175/17

(58) Field of Classification Search
USPC ..... 166/51, 57, 90.1, 302, 84.2; 175/17, 175/205, 214
See application file for complete search history.

(56) References Cited

U.S. PATENT DOCUMENTS

| | | | | |
|---|---|---|---|---|
| 5,224,557 | A * | 7/1993 | Yenulis et al. | 175/195 |
| 5,277,249 | A | 1/1994 | Yenulis et al. | |
| 5,662,181 | A | 9/1997 | Williams et al. | |
| 5,715,895 | A * | 2/1998 | Champness et al. | 175/17 |
| 6,749,172 | B2 | 6/2004 | Kinder | |
| 7,004,444 | B2 | 2/2006 | Kinder | |
| 7,040,394 | B2 | 5/2006 | Bailey et al. | |
| 2006/0144622 | A1 | 7/2006 | Bailey et al. | |
| 2008/0210471 | A1 | 9/2008 | Bailey et al. | |
| 2009/0101411 | A1 | 4/2009 | Hannegan et al. | |

FOREIGN PATENT DOCUMENTS

CA 1149728 A 7/1983

* cited by examiner

*Primary Examiner* — David Bagnell
*Assistant Examiner* — Taras P Bemko
(74) *Attorney, Agent, or Firm* — St. Onge Steward Johnston & Reens LLC

(57) ABSTRACT

Systems and methods for cooling a Rotating Control Device (RCD) and RCD insert during drilling operations are described. The system includes a body for connection between the RCD and a hot drilling fluid return outlet of a well head, the body including an inlet for injecting cool drilling fluid adjacent the RCD insert and an outlet for removing partially warmed drilling fluid. During operation, cool drilling fluid is circulated through the inlet and outlet such that cool drilling fluid is in direct contact with hot drilling fluid recovered from the well in a buffer zone adjacent the hot drilling fluid return outlet.

12 Claims, 3 Drawing Sheets

ROTATING CONTROL DEVICE, COOL FLUID CIRCULATION SYSTEM AND METHODS OF OPERATION

CROSS-REFERENCE TO RELATED APPLICATIONS

The present application claims the benefit under 35 U.S.C. §119 (e) of the U.S. Provisional Patent Application Ser. No. 61/241,317 filed on Sep. 10, 2009.

FIELD OF THE INVENTION

This application relates to the field of oilfield equipment and more specifically to a Rotating Control Device (RCD) and Cool Fluid Circulation System (CFCS) for managing drilling fluid composition and temperature across the interface of an RCD insert.

BACKGROUND OF THE INVENTION

As is known, in managed pressure applications, there is a need to dynamically and effectively control fluid pressure within a wellbore during drilling. More specifically, it is important to maintain drilling fluid in a wellbore at a pressure less than or equal to the fluid pressure of a geological formation in order to prevent drilling related problems such as stuck pipes, loss of circulation and excessive use of drilling mud.

Drilling fluid is required during drilling operations to lubricate the drill bit and carry drill cuttings to the surface. Typically, drilling fluid is pumped downwardly through the drill pipe to the drill bit whereupon it returns upwardly to the surface through the wellbore annulus. Drilling fluid returning to the surface will be affected by gravity and friction encountered along the walls of the wellbore thereby increasing the hydrostatic pressure at the bottom of the wellbore.

Managed Pressure Drilling (MPD) is an adaptive drilling process used to precisely control the annular pressure profile throughout a wellbore. More specifically, MPD allows bottom hole pressure adjustments with minimal interruptions to the drilling process. The annular pressure profile is controlled such that it is balanced or nearly balanced. The objective of MPD is to ascertain the downhole pressure environment limits and to manage the annular hydraulic pressure profile accordingly.

MPD uses a closed, pressurizable fluid system to control the annular pressure profile. More specifically, the annular pressure in the wellbore is controlled through adjustments in backpressure, fluid density, fluid rheology, annular fluid level, circulating geometry, hole geometry or the like.

Similarly, Underbalanced Drilling (UBD) uses a closed and pressurizable fluid system wherein the annular wellbore pressure profile is less than the fluid pressure in the formation being drilled. Annular pressure in the wellbore is similarly controlled through adjustments in backpressure, fluid density, fluid rheology, annular fluid level, circulating geometry, hole geometry and the like.

In order to prevent drilling related problems as described above, MPD and UBD decrease the Equivalent Circulating Density (ECD) by lowering the hydrostatic pressure of drilling fluid. A low density drilling fluid can mitigate the risk of a well becoming overbalanced and developing drilling problems. A gas is often injected into a drilling fluid in order to reduce the drilling fluid density. Some gases commonly used for drilling fluid injection include air, nitrogen, natural gas and processed flue gas. As is known, the use of natural gas and/or processed flue gas may increase the combustible and/or corrosive nature of the drilling fluid.

Furthermore, in MPD and UBD, drilling fluid is naturally heated while traveling to and from the drill bit by the drilling process and/or geological formations. As a result, drilling fluid often reaches temperatures greater than 65 degrees Celsius (149 degrees Fahrenheit) and can exceed 85 degrees Celsius (185 degrees Fahrenheit). Furthermore, drilling fluid may be comprised of or accumulate combustible and corrosive components during the drilling process.

As in other drilling operations, managed pressure and underbalanced drilling require a Blowout Preventer (BOP) to prevent an uncontrolled release of formation fluids from the wellbore. A release may cause significant damage to a drilling rig and injuries or fatalities to rig personnel. As a result, MPD and UBD further require that a Rotating Control Device (RCD) be installed on the top of the BOP stack to form a positive pressure seal on the drill pipe and safely divert drilling fluid away from the drill floor. An RCD typically contains a radial insert that forms a seal around the drill pipe.

As is known, RCD inserts are generally radial and fabricated from synthetic rubber such as neoprene or nitrile rubber. During drilling, the drill pipe is axially forced downwards through the RCD and RCD insert such that over time the RCD insert will incur wear and tear as the insert slidably engages the drill pipe. Thus, as a result of normal use, RCD inserts will deteriorate and become less effective over time. Furthermore, in particular, high temperature drilling fluid and/or any corrosive components of a drilling fluid will accelerate the deterioration of an RCD insert.

An RCD insert manufacturer will typically recommend a maximum operating lifetime before which RCD inserts should be replaced to ensure safe and productive operation of a drilling rig. The replacement of an RCD insert requires considerable Non Productive Time (NPT) as the drill string must be broken and the RCD disassembled. Accordingly, there continues to be a need for systems that can increase the time between RCD insert replacements.

As noted, temperature and/or corrosive drilling fluid may cause accelerated deterioration of an RCD insert such that the accelerated deterioration of an RCD insert may cause the premature and/or unexpected failure of the insert before the expiration of the manufacturer recommended maximum operating lifetime. Any premature or unexpected failure can present a significant safety risk to personnel if drilling fluid is released onto the drill floor.

Thus, while RCD inserts are currently manufactured to resist the corrosive chemical properties or high temperatures of returned drilling fluid, RCD inserts are generally not designed to resist the combination of both the corrosive chemical properties and high temperatures of returned drilling fluids found in many drilling operations.

More specifically, as is known to one of skill in the art, RCD inserts are generally designed to perform specifically to a recommended maximum operating temperature (typically 65-85° C.). Increases in temperature and/or corrosive drilling fluid compositions can decrease the operating lifetime of an RCD insert. Thus, the maximum operating lifetime of an RCD insert can be extended (and the risk of premature failure reduced) by decreasing the temperature of returned drilling fluid at the RCD insert/drilling fluid interface and/or moderating the composition of returned drilling fluid coming into contact with the RCD insert.

It is therefore an object of the present invention to improve the useful life of an RCD insert by providing a system and method for lowering the temperature and moderating the composition of returned drilling fluid coming into contact with an RCD insert within an RCD.

A review of the prior art reveals that a number of technologies have been used in the past for cooling inserts in a Rotating Control Device. For example US Patent Publications 2006/0144622 and 2008/0210471 to Bailey et al. disclose Rotating Control Devices (RCDs) having thermal transfer systems for circulating cooling fluid inside radial RCD seals.

U.S. Pat. Nos. 6,749,172 and 7,004,444 to Kinder disclose Rotating Control Devices (RCDs) having two independent fluid circuits for cooling and lubrication between a rotating body and the RCD casing.

Other references include U.S. Pat. No. 5,662,181 which describes circulating chilled water or antifreeze through the top seal packing box of an RCD and U.S. Pat. No. 5,277,249 which describes an RCD having a heat exchanger and fluid circuits for cooling radial seals in a packer assembly.

While the prior art may provide a partial solution, each are limited in various ways as briefly described below.

In particular, past systems may be limited as they do not suggest or teach the advantages of a cooling system in which the cooling fluid is in direct contact with the hot drilling fluid. More specifically, previous systems do not suggest a system to prevent hot drilling fluid from directly contacting the radial RCD inserts. Furthermore, previous systems do not teach moderating the composition of drilling fluid across the interface of a radial RCD insert.

SUMMARY OF THE INVENTION

It is the object of the present invention to obviate or mitigate at least one disadvantage of previous rotating control devices and specifically to provide systems and methods that enhance the operating life of an RCD insert within an RCD.

In accordance with a first embodiment of the invention, there is provided a cool fluid circulation system (CFCS) for circulating cool drilling fluid across a rotating control device (RCD) and RCD insert operatively connected to a well head having a hot drilling fluid return outlet, the CFCS comprising: a body for operative connection between the RCD and the hot drilling fluid return outlet at the well head, the body including an inlet for injecting cool drilling fluid adjacent the RCD insert and an outlet for removing partially warmed drilling fluid; wherein the cool drilling fluid is in direct contact with hot drilling fluid in a buffer zone adjacent the hot drilling fluid return outlet.

In further embodiments, the CFCS includes a void space above the inlet and outlet for containing and circulating a volume of cool drilling fluid adjacent the RCD insert and/or a second void space below the inlet and outlet for containing and circulating a volume of cool drilling fluid adjacent an interface with hot drilling fluid.

In another embodiment, the invention provides a system for circulating cool drilling fluid across a rotating control device (RCD) and RCD insert operatively connected to a well head having a hot drilling fluid return outlet, the CFCS comprising: a body for operative connection between the RCD and the hot drilling fluid return outlet at the well head, the body including an inlet for injecting cool drilling fluid adjacent the RCD insert and an outlet for removing partially warmed drilling fluid; wherein the cool drilling fluid is in direct contact with hot drilling fluid adjacent the hot drilling fluid return outlet; and, a cool drilling fluid circulation system operatively connected to the inlet for injecting cool drilling fluid into the inlet and for removing partially warmed drilling fluid from the outlet.

In a further embodiment, the system includes a choke system for controlling the flow rate and pressure of cool drilling fluid within the cool drilling fluid circulation system and will preferably include at least one temperature sensor operatively connected to the body for measuring the temperature of cool drilling fluid within the body and/or at least one pressure sensor operatively connected to the body for measuring the pressure of cool drilling fluid within the body.

In a further embodiment, the system includes a control system operatively connected to the temperature sensor and pressure sensor for automatically controlling the flow rate of cool drilling fluid within the cool drilling fluid circulation system in response to measured temperatures and pressures in the cool drilling fluid circulation system.

In another aspect, a method is described for circulating cool drilling fluid across a rotating control device (RCD) having an RCD inlet and an RCD outlet and RCD insert, the RCD operatively connected to a well head having a hot drilling fluid return outlet, the method comprising the step of: circulating a volume of cool drilling fluid adjacent the RCD insert through the RCD inlet and outlet wherein the cool drilling fluid is in direct contact with hot drilling fluid adjacent the hot drilling fluid return outlet.

In further embodiments of the method, the cool drilling fluid recovered from the RCD outlet is subjected to a cooling process prior to recirculating cool drilling fluid into the RCD inlet.

In yet another embodiment, the cool drilling fluid recovered from the RCD outlet is subjected to a solids separation process prior to recirculating cool drilling fluid into the RCD inlet.

In yet another embodiment, the temperature of the cool drilling fluid recovered from the RCD outlet is monitored and the flow rate of the cool drilling fluid is adjusted through the RCD to ensure adequate cooling of the RCD insert.

BRIEF DESCRIPTION OF THE DRAWINGS

The invention is described with reference to the accompanying figures in which.

DETAILED DESCRIPTION OF THE INVENTION

Figure 1:
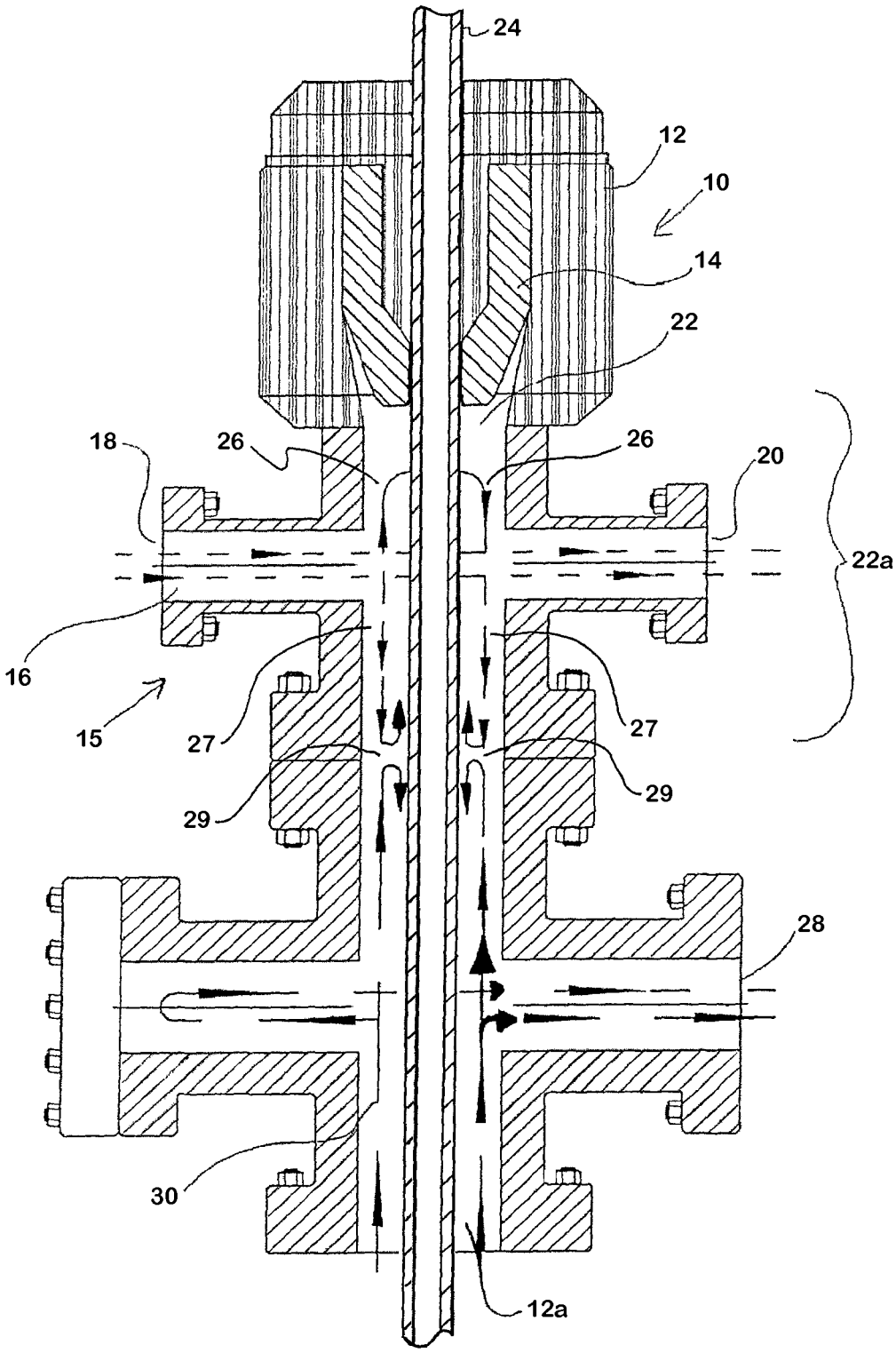
FIG. 1 is a cross sectional view of a Rotating Control Device and Cool Fluid Circulation System (CFCS) having a cool drilling fluid inlet and outlet in accordance with one embodiment of the invention.

As used herein, the term "returned drilling fluid" 30 refers to all fluids, solids and gases in a drilling operation that have been returned to the surface through a wellbore 40 including drilling fluid, drill cuttings, oil and the like.

Overview

With reference to the figures, the present invention generally relates to a system enabling the circulation of cool drilling fluid through a Rotating Control Device (RCD) 10 and RCD insert 14. The device and its control system are particularly useful in managed pressure or underbalanced well drilling.

As known, an RCD 10 and RCD insert 14 generally seals around and rotates with a drill pipe 24 to prevent drilling fluid circulating through the annulus from escaping onto the drill floor. In addition, the RCD 10 and RCD insert 14 permits the drill pipe 24 to slide into and out of the wellbore while maintaining a tight seal on the drill pipe 24. Within known systems, a main drilling fluid outlet 28 at the well head allows drilling fluid to be removed from the annulus of the well for drill cutting removal and re-use. In various applications, a well incorporating an RCD may include other systems for enhancing the hydraulic pressure seal and/or to provide other functions to and around a drill pipe 24 as known to those skilled in the art.

In accordance with the invention, the RCD further includes a cool fluid circulation system (CFCS) 15 for operative connection between the RCD and main drilling fluid outlet 28 of the well. The CFCS 15 includes a cool drilling fluid inlet 18 and cool drilling fluid outlet 20 that enables the circulation of cool drilling fluid 16 across the lower surfaces of the RCD insert 14 and within an RCD cavity 22. In accordance with the objects of the present invention, the circulation of cool drilling fluid 16 across the lower surfaces of the RCD insert 14 lowers the temperature and moderates the composition of drilling fluid in the RCD cavity 22 thereby slowing the deterioration of the RCD insert 14. As a result, the present invention will increase the maximum operating lifetime and mitigate the risk of premature failure of an RCD insert 14.

Figure 2:
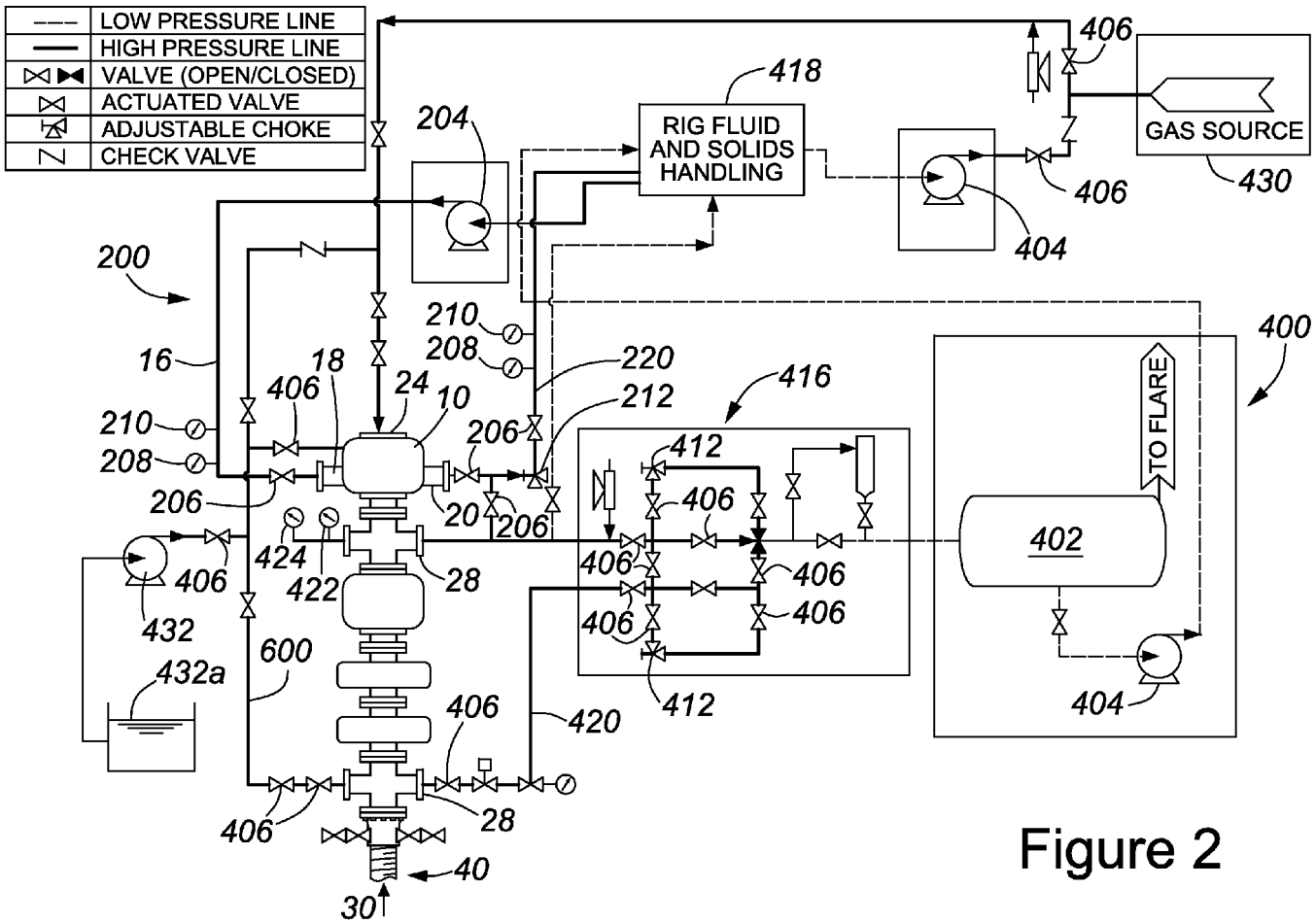
FIG. 2 is a schematic diagram of a primary circulation system and cool drilling fluids circulation system in accordance with one embodiment of the invention; and, FIG. 3 is a schematic representation of a decision making process for controlling the pressure of cool drilling fluid in accordance with one embodiment of the invention.
Figure 3:
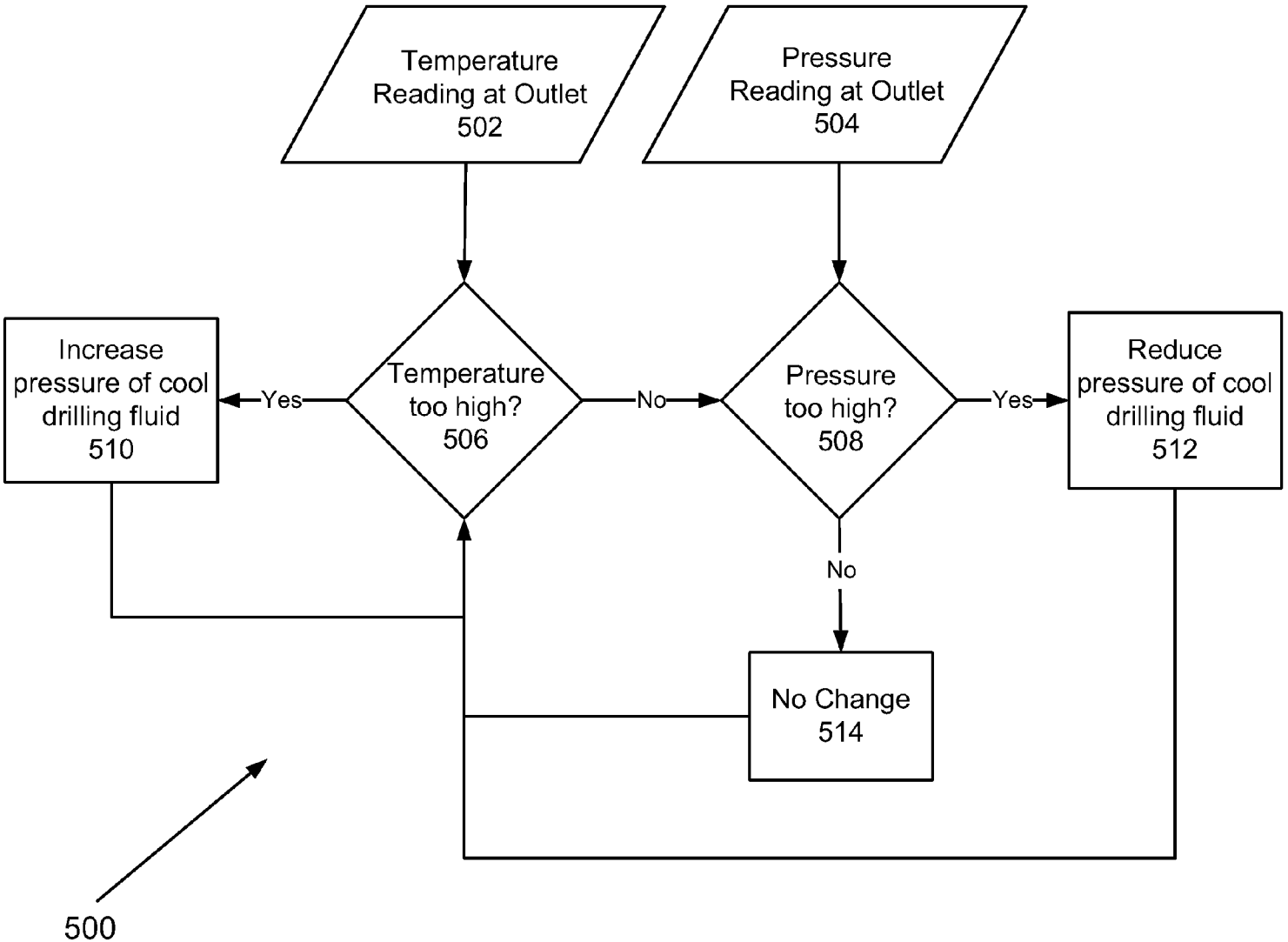

In addition, the present invention further includes external fluid circuits for circulating drilling fluids and cool drilling fluids (FIG. 2). A first drilling fluid circuit 400 withdraws returned drilling fluid from the wellbore and inserts recycled drilling fluid down the drill pipe 24. A second drilling fluid circuit 200 circulates cool drilling fluid 16 across the interface of the RCD insert within the rotating control device 10. A control system 500 monitors the circulation of drilling fluids (FIG. 3).

Rotating Control Device and Cool Fluid Circulation System

FIG. 1 generally describes an RCD 10 which as known to those skilled in the art includes a body 12 and a bearing assembly (not shown) retained within the body 12 that rotates with drill pipe 24 and that operatively supports the RCD insert. The bearing assembly is operationally located between the RCD body 12 and a drill pipe 24 so as to permit rotational movement of the RCD insert with respect to the body. As known, the drill pipe 24 will pass through the top of the RCD body 12, RCD insert 14 and into the wellbore.

As shown in FIGS. 1 and 2, returned drilling fluid 30 flowing upwardly within the annular column 12*a* is withdrawn through an outlet 28 into a first fluid circuit 400. During Managed Pressure or Underbalanced drilling that does not include a CFCS 15, the returned drilling fluid 30 fills the RCD cavity 22 and is in direct contact with the RCD insert 14.

In accordance with the invention, the CFCS 15 includes a cool drilling fluid inlet 18 and cool drilling fluid outlet 20 operationally connected to the RCD below the RCD insert 14. Both the inlet 18 and outlet 20 are connected to the cool drilling fluid circulation system 200. The inlet 18 and outlet 20 are diametrically opposite each other and are located above the returned drilling fluid outlet 28 in the annulus 12*a*.

In operation, cool drilling fluid 16 enters the CFCS through the cool drilling fluid inlet 18 to create a buffer zone 22*a* of cool drilling fluid between the returned drilling fluid and the RCD insert. The inlet 18 is positioned to generally direct cool drilling fluid 16 across the interface of the RCD insert 14 such that the buffer zone 22*a* prevents returned drilling fluid 30 from directly contacting the RCD insert 14. A cool drilling fluid outlet 20 is positioned opposite to the inlet 18 in order to withdraw cool drilling fluid 16 from the buffer zone and RCD cavity 22.

Importantly, the temperature and pressure of drilling fluid within the buffer zone 22*a* can be controlled and any abrasive or corrosive components of returned drilling fluid 30 will be substantially prevented from contacting the RCD insert 14. In other words, the combined design of the RCD 10, the CFCS 15 and the operational temperature and pressure of cool drilling fluid 16 are designed and controlled to prevent substantive mixing and diffusion of returned drilling fluid 30 into the RCD cavity 22 so as to provide maximum cooling and fluid composition moderation across the lower surfaces of the RCD insert.

In further embodiments, the CFCS includes a void space 26 above the inlet and outlet for containing and circulating a volume of cool drilling fluid adjacent the RCD insert and/or a second void space 27 below the inlet and outlet for containing and circulating a volume of cool drilling fluid adjacent an interface 29 with hot drilling fluid.

Primary Drilling Fluid Circulation System and Cool Fluids Circulation System

With reference to FIG. 2, the invention further provides a system enabling the use of the CFCS within a drilling operation. The system includes a primary drilling fluids circulation system 400 and a cool fluids circulation system 200 for operative connection to the CFCS.

The primary drilling fluids circulation system (primary fluid circuit) 400 enables downhole pumping of drilling fluid, surface recovery of returned drilling fluid, surface cleaning and separation of returned drilling fluid, chemical modification of drilling fluid and re-circulation of returned drilling fluid 30. Within the primary fluid circuit, drilling fluids are pumped down the drill pipe to the drill bit, and returned upwardly to the surface between the drill pipe and wellbore 40 where the returned drilling fluid is withdrawn through the annular outlet 28. At surface, the primary fluid circuit 400 includes piping 420, storage tanks 402 and pumps 404 as required for the operation of the primary fluid circuit 400.

In addition, as it is desirable to remove undesirable components such as drill cuttings and oil from the returned drilling fluid 30 before the recirculation of drilling fluid down the drill pipe 24, the primary fluid circuit 400 will typically include a separation system 418 for removing drill cuttings, oil and other contaminants from the returned drilling fluid 30. The separation system may include components such as a shale shaker, sedimentation tanks, chemical processing, and/or cleaning systems and the like in order that clean drilling fluid 30 is reused and pumped down the drill pipe 24.

The primary fluid circuit 400 will further include appropriate manifolds 416, valves 406 and choking devices 412 to enable control of the pressure and flow of drilling fluid 30 and/or chemical injection/adjustment within the system. Other systems may include gas injection 430 as well as standard well kill systems including pump 432 and kill mud tanks 432*a*.

The primary fluid circuit will also include appropriate temperature 422 and pressure sensors 424 to monitor drilling fluid properties.

The cooling fluid circulation system (cool fluid circuit) 200 is provided to insert cool drilling fluid 16 into the cool drilling fluid inlet 18 and withdraw drilling fluid from cool drilling fluid outlet 20. The cool fluid circuit 200 includes piping 220, a fluids handling system operating in conjunction with the separation system 418 and appropriate pumps 204 as required for the operation of the cooling fluid circulation system. Appropriate valves 206 are also provided to stop or redirect cool drilling fluid 16 flow as may be desired within a specific system.

Operation

Generally, in operation, in order to provide effective RCD insert cooling, it is necessary to balance the pressure and flow rate of cool drilling fluid 16 circulating in the RCD cavity. For example, insufficient cool drilling fluid 16 pressure and flow would generally cause the temperature of RCD insert 14 to rise whereas conversely, high pressure cool drilling fluid 16 may cause undesirable mixing and diffusion between the cool drilling fluid 16 and the returned drilling fluid 30.

As a result, as the pressure of returned drilling fluid 30 may change over time, a choking device 212 may be installed downstream of the RCD outlet 20 in order to control the pressure of cool drilling fluid 16 within the RCD. Choking device 212 can be adjusted to increase or decrease the flow of cool drilling fluid 16 as required to maintain a desired pressure and flow of cool drilling fluid within the RCD cavity 22.

The cool fluid circuit 200 may further include appropriate sensors to monitor drilling fluid 16 characteristics such as the temperature and pressure within the circuit. In a preferred embodiment, temperature 208 and pressure 210 sensors are located at the cool drilling fluid inlet 18 and outlet 20 to the RCD 10. The system will also preferably include emergency release piping 420 to enable effective diversion in the event of an emergency as well as equalization and bleed-off piping 600 as known to those skilled in the art.

In another embodiment, the cooling fluid circulation system 200 may include a refrigeration system (not shown) for actively or passively cooling drilling fluids.

Control System

The RCD, primary fluid circuit 400 and cooling fluid circulation system 200 may be monitored and controlled by a control system 500. In a preferred embodiment, the control system 500 is electronic and operationally connected to appropriate temperature sensors 214, 424, pressure sensors 216, 426, valves 206, 406 and choking devices 212, 412 in order to enable effective control of the system during drilling.

In one embodiment, temperature and pressure sensors operationally transmit temperature and pressure data to the control system. The control system may decide to increase or decrease fluid pressure within the primary fluid circuit 400 or cooling fluid circulation system 200 as required for drilling and the optimal operation of the RCD 10 and CFCS 15. More specifically, the control system may instruct a choking device 212, 412 to increase or decrease fluid pressure in the desired fluid circuit.

Referring to FIG. 3, a preferred embodiment of a control decision structure is provided. By way of example, the electronic interface may take a temperature reading at the RCD outlet 502 and determine if the temperature is too high 506. If the temperature is too high, the control system will take steps to increase cool drilling fluid pressure 510. Increased cool drilling fluid pressure may be provided by closing a choking device 212 or increasing pump pressure 204. Conversely, if the temperature reading at the outlet 502 is not too high, the control system will evaluate if the pressure reading at the RCD outlet 504 is too high 508. If the pressure reading 504 at the outlet is too high, the control system will reduce the pressure of cool drilling fluid 512. If the pressure is not too high, no adjustments will be made by the control system 514.

Similar embodiments can be realized by alternate positioning of sensors and control decision structures.

Although the present invention has been described and illustrated with respect to preferred embodiments and preferred uses thereof, it is not to be so limited since modifications and changes can be made therein which are within the full, intended scope of the invention as understood by those skilled in the art.

What is claimed is:

1. A cool fluid circulation system (CFCS) for circulating cool drilling fluid across a rotating control device (RCD) and RCD insert operatively connected to a well head having a hot drilling fluid return outlet, the CFCS comprising:

a body for operative connection between and for separating the RCD and the hot drilling fluid return outlet at the well head, the body including a CFCS inlet for injecting cool drilling fluid adjacent the RCD insert and a CFCS outlet for removing partially warmed drilling fluid;

a void space within the body adjacent the CFCS inlet and CFCS outlet for containing and circulating a volume of cool drilling fluid adjacent the RCD insert, and creating a buffer zone between the hot drilling fluid return outlet and the RCD insert, wherein the cool drilling fluid is in direct contact with the RCD insert; and wherein during cool drilling fluid circulation, the cool drilling fluid is in direct contact with the hot drilling fluid between the buffer zone and the hot drilling fluid return outlet, preventing the hot drilling fluid from directly contacting the RCD insert.

2. The system as in claim 1 wherein the void space is above the CFCS inlet and CFCS outlet.

3. The system as in claim 2 further comprising a second void space below the CFCS inlet and CFCS outlet for containing and circulating a volume of cool drilling fluid adjacent below the CFCS inlet and the CFCS outlet.

4. The system as in claim 1 wherein the cool drilling fluid circulation system includes a choke system for controlling the flow rate and pressure of cool drilling fluid within the cool drilling fluid circulation system.

5. The system as in claim 4 further comprising at least one temperature sensor operatively connected to the body for measuring the temperature of cool drilling fluid within the body.

6. The system as in claim 5 further comprising at least one pressure sensor operatively connected to the body for measuring the pressure of cool drilling fluid within the body.

7. The system as in claim 6 further comprising a control system operatively connected to the temperature sensor and pressure sensor for automatically controlling the flow rate of cool drilling fluid within the cool drilling fluid circulation system in response to measured temperatures and pressures in the cool drilling fluid circulation system.

8. The system as in claim 7 wherein partially warmed drilling fluid is cooled and re-circulated within the system.

9. A method for circulating cool drilling fluid across a rotating control device (RCD) having an RCD inlet and an RCD outlet and RCD insert, the RCD operatively connected to a well head having a hot drilling fluid return outlet and wherein the RCD defines a void space between the hot drilling fluid return outlet and the RCD insert, the method comprising the step of:

circulating a volume of cool drilling fluid adjacent the RCD insert through the RCD inlet and RCD outlet wherein the cool drilling fluid is in direct contact with the RCD insert, and wherein the cool drilling fluid is in direct contact with the hot drilling fluid adjacent the hot drilling fluid return outlet, preventing the hot drilling fluid from directly contacting the RCD insert.

10. The method as in claim 9 further comprising the step of subjecting cool drilling fluid recovered from the RCD outlet to a cooling process prior to recirculating cool drilling fluid into the RCD inlet.

11. The method as in claim 10 further comprising the step of subjecting cool drilling fluid recovered from the RCD outlet to a solids separation process prior to recirculating cool drilling fluid into the RCD inlet.

12. The method as in claim 9 further comprising the step of monitoring the temperature of the cool drilling fluid recovered from the RCD outlet and adjusting the flow rate of the cool drilling fluid through the RCD to ensure adequate cooling of the RCD insert.

* * * * *